US011685482B2

(12) United States Patent
de Jager et al.

(10) Patent No.: US 11,685,482 B2
(45) **Date of Patent: *Jun. 27, 2023**

(54) WATERSPORT BOARD FINS WITH FIN RETENTION SYSTEMS AND WATERSPORT BOARDS CONTAINING THE SAME

(71) Applicant: Vista Outdoor Operations LLC, Anoka, MN (US)

(72) Inventors: Wim de Jager, Park City, UT (US); Jason Brewer, Salt Lake City, UT (US)

(73) Assignee: Vista Outdoor Operations LLC, Anoka, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/029,467

(22) Filed: Sep. 23, 2020

(65) Prior Publication Data

US 2021/0139112 A1 May 13, 2021

Related U.S. Application Data

(63) Continuation of application No. 16/240,565, filed on Jan. 4, 2019, now Pat. No. 10,807,682, which is a continuation of application No. 15/593,211, filed on May 11, 2017, now Pat. No. 10,173,757.

(51) Int. Cl.
*B63B 32/66* (2020.01)

(52) U.S. Cl.
CPC ..... *B63B 32/66* (2020.02)

(58) Field of Classification Search
CPC ... B63B 35/7926; B63B 35/793; B63B 32/60; B63B 32/62; B63B 32/66
See application file for complete search history.

(56) References Cited

U.S. PATENT DOCUMENTS 5,934,963 A * 8/1999 Frizzell ..... B63B 32/66 441/79

* cited by examiner

*Primary Examiner* — Andrew Polay
(74) *Attorney, Agent, or Firm* — Amardeep S. Grewal; Gerard M. Donovan; Reed Smith LLP

(57) ABSTRACT

Watersport board fins with fin retention systems and associated watersport boards and methods. A fin includes a hydrodynamic blade and a fin base extending from the hydrodynamic blade. The hydrodynamic blade defines a fin plane and includes a leading edge, a trailing edge, and a foil surface. The fin further includes a fin retention system with a selective retention system that includes a retainer and an actuator coupled to the retainer via a pivot shaft. The actuator forms a portion of the hydrodynamic blade when the selective retention system is in a locked configuration and is configured to rotate away from the fin plane when the selective retention system transitions from the locked configuration to an unlocked configuration. The retainer is configured to rotate away from the fin plane when the selective retention system transitions from the unlocked configuration to the locked configuration.

17 Claims, 12 Drawing Sheets

WATERSPORT BOARD FINS WITH FIN RETENTION SYSTEMS AND WATERSPORT BOARDS CONTAINING THE SAME

RELATED APPLICATION DATA

This application is a continuation of U.S. patent application Ser. No. 16/240,565, filed Jan. 4, 2019, which itself is a continuation of U.S. patent application Ser. No. 15/593,211, filed May 11, 2017 and issued on Jan. 8, 2019 as U.S. Pat. No. 10,173,757, the disclosures of which are hereby incorporated by reference in their entirety.

FIELD

The present disclosure relates to watersport board fins with fin retention systems, watersport boards containing the same, and associated methods.

BACKGROUND

Watersport boards such as surfboards and stand-up paddleboards (SUPs) generally are configured to permit a user to stand upon an upper surface of the watersport board while the watersport board floats in a body of water. A watersport board may include at least one fin extending into the body of water from an underside of the watersport board to stabilize the watersport board and/or to provide the user with directional control as the watersport board traverses the body of water. A fin that is integrally formed with the watersport board or permanently coupled to the watersport board may be difficult to repair and/or replace in the event of damage, such as may result from a collision with a foreign object. Accordingly, a watersport board may include a fin box or other structure configured to selectively receive and retain the fin in an operative position on the watersport board. Conventional fin boxes and removable fins may require the use of tools to retain the fin within the fin box and/or to remove the fin from the fin box. Other conventional fin boxes and removable fins do not require the use of tools but may not sufficiently secure the fin in the fin box to prevent unintentional removal of the fin from the fin box during use of the watersport board. Thus, there exists a need for watersport board fins with fin retention systems.

SUMMARY

Watersport board fins with fin retention systems, watersport boards containing the same, and associated methods are disclosed herein. A fin to be inserted into a fin box of a watersport board for stabilizing the watersport board during use on a body of water includes a hydrodynamic blade and a fin base. The hydrodynamic blade is configured to extend into a body of water when the fin is coupled to a watersport board that operates on the body of water. The hydrodynamic blade defines a fin plane and includes a leading edge, a trailing edge, and a foil surface extending between the leading edge and the trailing edge. The fin base extends from the hydrodynamic blade and is configured to be selectively received within a fin box of the watersport board.

The fin further includes a fin retention system configured to restrict removal of the fin base from the fin box. The fin retention system includes a selective retention system configured to selectively transition between an unlocked configuration, in which the selective retention system permits the fin to be inserted into and removed from the fin box, and a locked configuration, in which the selective retention system restricts the fin from being inserted into and removed from the fin box. The selective retention system includes a retainer configured to extend within a retention channel of the fin box to restrict removal of the fin base from the fin box when the fin base is inserted into the fin box and the selective retention system is in the locked configuration. The retainer further is configured to pivot about a pivot axis when the selective retention system is transitioned between the unlocked configuration and the locked configuration. The selective retention system further includes an actuator coupled to the retainer via a pivot shaft and configured to be actuated by a user to pivot the retainer about the pivot axis to selectively transition the selective retention system between the unlocked configuration and the locked configuration. The actuator forms a portion of the hydrodynamic blade when the selective retention system is in the locked configuration and is configured to rotate away from the fin plane when the selective retention system transitions from the locked configuration to the unlocked configuration. The retainer is configured to rotate away from the fin plane when the selective retention system transitions from the unlocked configuration to the locked configuration.

DETAILED DESCRIPTION

FIGS. 1-24 provide examples of watersport board fins 100 according to the present disclosure, of watersport boards 10 including watersport board fins 100, and/or of methods 200 for forming watersport board fins 100. Elements that serve a similar, or at least substantially similar, purpose are labeled with like numbers in each of FIGS. 1-24, and these elements may not be discussed in detail herein with reference to each of FIGS. 1-24. Similarly, all elements may not be labeled in each of FIGS. 1-24, but reference numbers associated therewith may be utilized herein for consistency. Elements, components, and/or features that are discussed herein with reference to one or more of FIGS. 1-24 may be included in and/or utilized with the subject matter of any of FIGS. 1-24 without departing from the scope of the present disclosure.

In general, elements that are likely to be included in a given (i.e., a particular) embodiment are illustrated in solid lines, while elements that are optional to a given embodiment are illustrated in dashed lines. However, elements that are shown in solid lines are not essential to all embodiments, and an element shown in solid lines may be omitted from a given embodiment without departing from the scope of the present disclosure.

Figure 1:
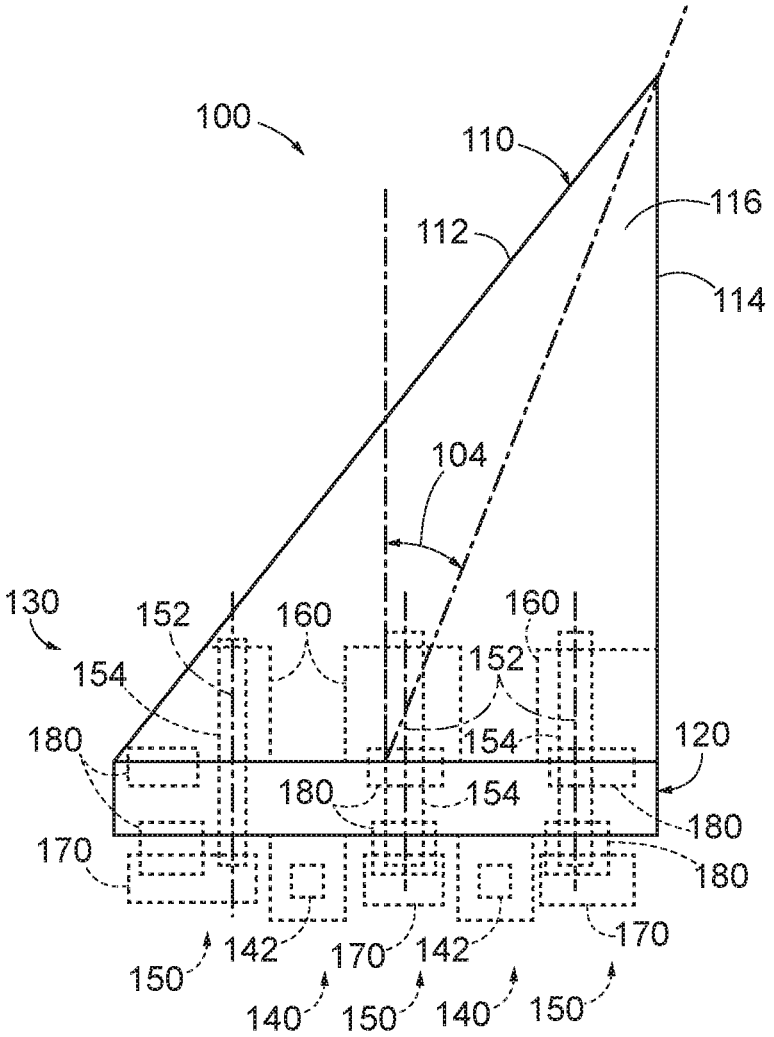
FIG. 1 is a schematic side elevation view representing examples of watersport board fins according to the present disclosure.
Figure 2:
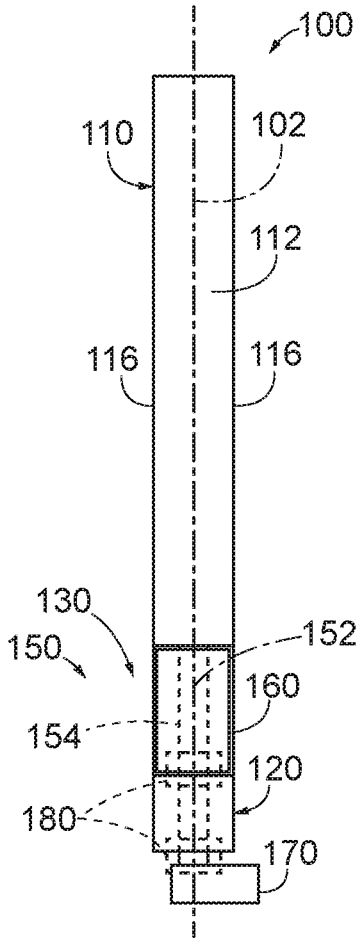
FIG. 2 is a schematic front elevation view representing examples of watersport board fins according to the present disclosure with a selective retention system in the locked configuration.
Figure 3:
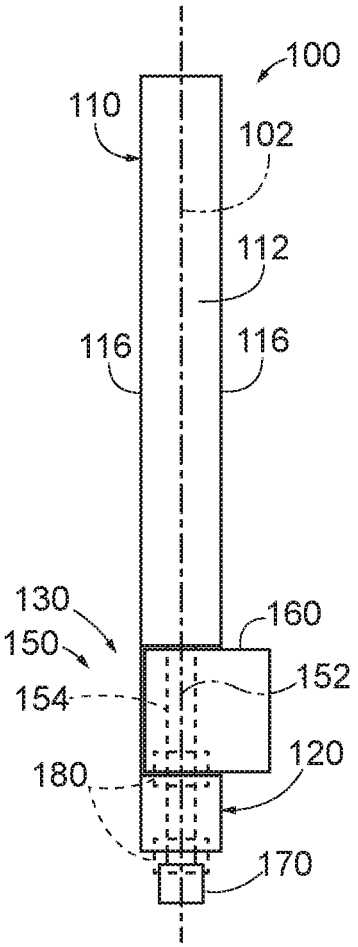
FIG. 3 is a schematic front elevation view representing examples of watersport board fins according to the present disclosure with the selective retention system in the unlocked configuration.

As schematically illustrated in FIGS. 1-3, a watersport board fin 100 includes a hydrodynamic blade 110 configured to extend into a body of water when the fin is coupled to a watersport board that operates upon the body of water. As used herein, watersport board fin 100 also may be referred to as a fin 100. Hydrodynamic blade 110 defines a fin plane 102 and includes a leading edge 112, a trailing edge 114, and a foil surface 116 extending between the leading edge and the trailing edge. Leading edge 112 may be described as facing a front side of the watersport board, and trailing edge 114 may be described as facing a rear side of the watersport board, when fin 100 is operatively coupled to the watersport board. Foil surface 116 may be configured to produce a desired hydrodynamic effect when fin 100 is coupled to a watersport board that operates upon a body of water, such as to stabilize the watersport board upon the body of water and/or to produce a lift force on at least a portion of the watersport board as the watersport board traverses the body of water. As more specific examples, foil surface 116 may be configured such that hydrodynamic blade 110 has a cross-sectional shape that includes and/or defines an airfoil and/or a hydrofoil. Additionally, and as schematically illustrated in FIG. 1, a shape of fin 100 and/or hydrodynamic blade 110 may be characterized by a rake angle 104, such as may be selected to produce a desired hydrodynamic effect when the fin is coupled to a watersport board that operates upon a body of water.

Fin 100 further includes a fin base 120 extending from hydrodynamic blade 110 and configured to be selectively received and retained within a fin box of a watersport board to operatively couple the fin to the watersport board. More specifically, the fin box may include a retention channel configured to receive fin base 120. As used herein, a fin 100 that is coupled to a watersport board also may be referred to as being installed in, received in, and/or affixed to the watersport board and/or to a fin box thereof. Similarly, a configuration in which fin 100 is coupled to, installed in, received in, and/or affixed to a fin box also may be referred to as a configuration in which fin base 110 is coupled to, installed in, received in, and/or affixed to the fin box.

As used herein, positional and directional terms such as "front," "bottom," "forward," "rear," "backward," "upper," "top," "lower," "underside," and the like are considered with respect to a watersport board resting on a body of water with a deck portion thereof facing away from the body of water such that a fin installed in the watersport board is in a downward orientation and extends vertically downward from the watersport board and with leading edge 112 of hydrodynamic blade 110 facing a front end of the watersport board and with trailing edge 114 of the hydrodynamic blade facing a rear end of the watersport board. Thus, for example, leading edge 112 may be described as being positioned in front of trailing edge 114. As an additional example, fin base 120 may be described as being positioned above hydrodynamic blade 110.

Fin 100 includes a fin retention system 130 configured to selectively restrict removal of the fin from a fin box. As schematically illustrated in FIG. 1, fin retention system 130 may include a static retention structure 140 that is configured to restrict removal of fin 100 from a fin box via obstruction of the static retention structure by a portion of the fin box. As an example, and as schematically illustrated in FIG. 1, static retention structure 140 may include at least one channel pin 142 that is configured to be obstructed by a portion of the fin box when fin base 120 is received in the fin box.

Fin retention system 130 further includes a selective retention system 150 that is configured to selectively transition between an unlocked configuration and a locked configuration. Selective retention system 150 is configured to permit fin 100 to be inserted into and removed from a fin box while in the unlocked configuration, and is configured to restrict the fin from being inserted into and/or removed from the fin box while in the locked configuration. Selective retention system 150 may be configured to be selectively transitioned between the locked configuration and the unlocked configuration without the use of tools and without disassembling a portion of fin 100, thereby enabling a user to readily install and uninstall the fin from a watersport board without additional equipment and without misplacing a component of the fin. Furthermore, when in the locked configuration, the selective retention system is configured to resist unintentional transitioning to the unlocked configuration during use of the watersport board.

As schematically illustrated in FIGS. 1-3, selective retention system 150 includes a retainer 170 that is configured to extend within the retention channel of the fin box to restrict removal of fin base 120 from the fin box when fin 100 and/or the fin base is inserted into the fin box and the selective retention system is in the locked configuration. Retainer 170 is configured to pivot about a pivot axis 152 when selective retention system 150 is transitioned between the unlocked configuration and the locked configuration. Selective retention system 150 further includes an actuator 160 coupled to retainer 170 via a pivot shaft 154 and configured to be actuated by a user to pivot the retainer about pivot axis 152 to selectively transition the selective retention system between the unlocked configuration and the locked configuration. Actuator 160 may be configured to be actuated without the use of tools, such as by being rotated by a user's fingers.

FIG. 2 schematically illustrates examples of fins 100 with selective retention system 150 in the locked configuration, while FIG. 3 schematically illustrates examples of fins with the selective retention system in the unlocked configuration. As schematically illustrated in FIGS. 1-2, actuator 160 forms a portion of hydrodynamic blade 110 when selective retention system 150 is in the locked configuration. Stated differently, a surface of actuator 160 may be described as being at least substantially aligned and/or coplanar with fin plane 102, as being at least substantially coplanar and/or coextensive with foil surface 116, and/or as conforming to the foil surface, when selective retention system 150 is in the locked configuration. Such a configuration may permit selective retention system 150 and/or actuator 160 to augment, complement, and/or otherwise not adversely effect a desired hydrodynamic effect produced by hydrodynamic blade 110. As schematically illustrated in FIGS. 2-3, actuator 160 is configured to rotate away from fin plane 102 when selective retention system 150 transitions from the locked configuration to the unlocked configuration, while retainer 170 is configured to rotate away from the fin plane when the selective retention system transitions from the unlocked configuration to the locked configuration.

As schematically illustrated in FIG. 1, selective retention system 150 may include one actuator 160 and/or retainer 170, or more than one actuator 160 and/or retainer 170. Examples include one actuator and one retainer, two actuators and two retainers, or more than two actuators and/or more than two retainers. As further schematically illustrated in FIG. 1, actuator 160 may be positioned at any appropriate location with respect to hydrodynamic blade 110. As examples, when selective retention system 150 is in the locked configuration, actuator 160 may form a portion of leading edge 112, may form a portion of trailing edge 114, may form a portion of foil surface 116, and/or may be spaced apart from at least one, and optionally both, of the leading edge and the trailing edge. As further schematically illustrated in FIGS. 1-3, and as discussed herein, fin 100 may include at least one retention system lock 180 configured to maintain selective retention system 150 in the locked configuration.

Figure 4:
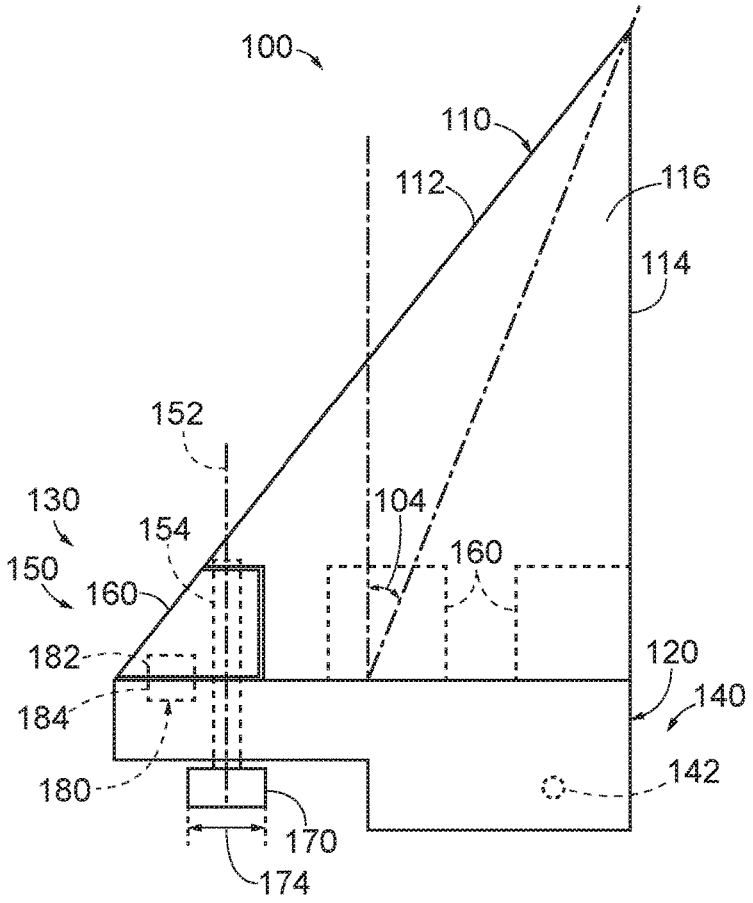
FIG. 4 is a schematic side elevation view representing examples of watersport board fins according to the present disclosure with the selective retention system in the locked configuration.
Figure 5:
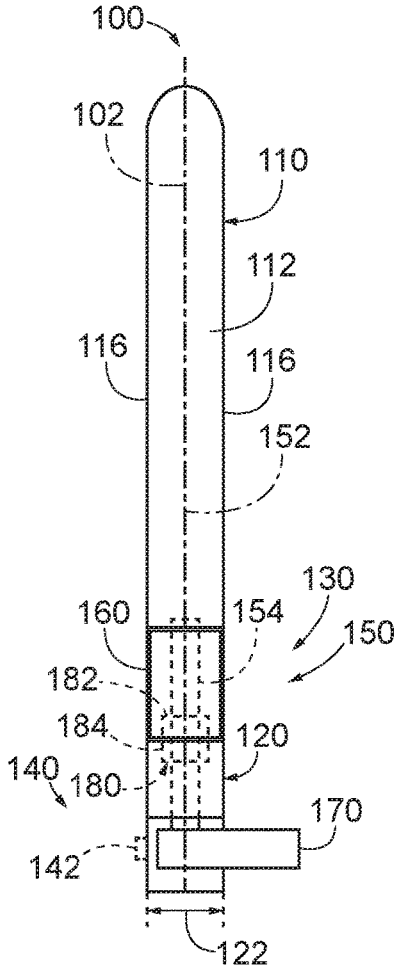
FIG. 5 is a schematic front elevation view of the watersport board fins of FIG. 4.
Figure 6:
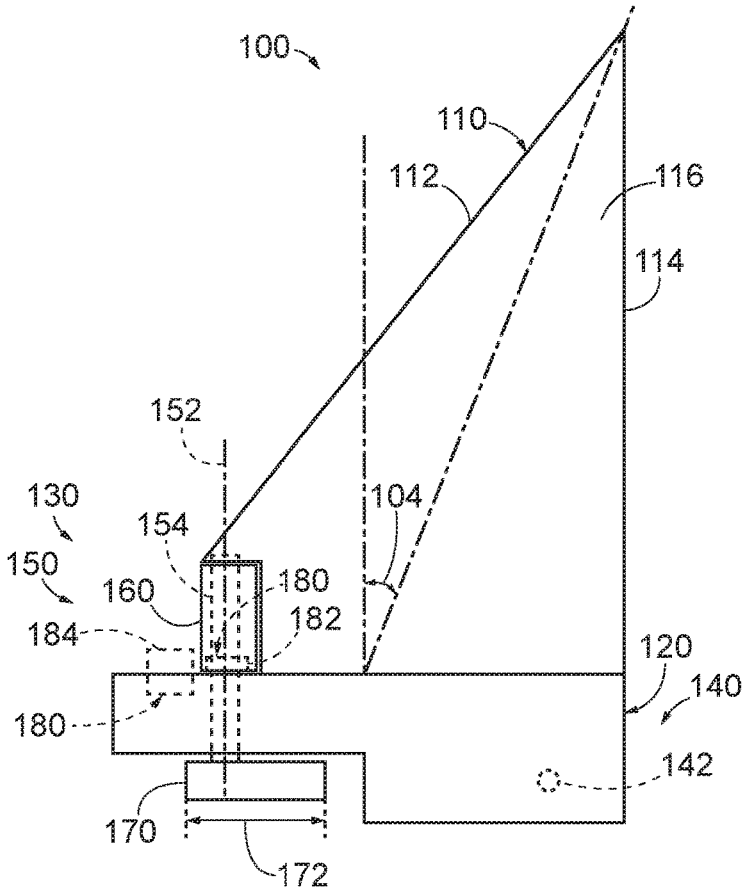
FIG. 6 is a schematic side elevation view representing examples of watersport board fins according to the present disclosure with the selective retention system in the unlocked configuration.
Figure 7:
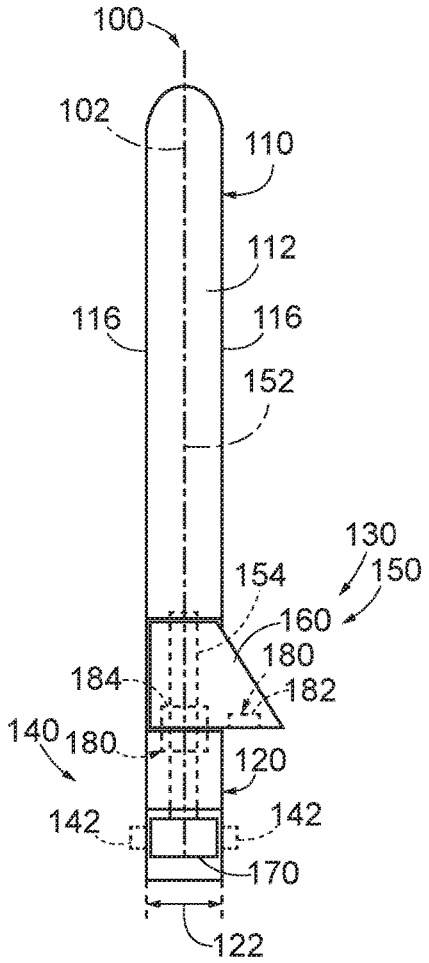
FIG. 7 is a schematic front elevation view of the watersport board fins of FIG. 6.

FIGS. 4-7 provide slightly less schematic examples of a fin 100 according to the present disclosure that includes static retention structure 140 and selective retention system 150. Specifically, FIGS. 4-5 illustrate an example of fin 100 with selective retention system 150 in the locked configuration, while FIGS. 6-7 illustrate the fin with the selective retention system in the unlocked configuration. In the example of FIGS. 4-7, static retention structure 140 includes a pair of channel pins 142 extending from opposed surfaces of fin base 120 and configured to be obstructed by at least a portion of the fin box when the fin base is inserted into the fin box.

The example of fin 100 schematically illustrated in FIGS. 4-7 further includes a selective retention system 150 with an actuator 160 that forms a portion of leading edge 112 of hydrodynamic blade 110 when the selective retention system is in the locked configuration. However, this is not required to all fins 100, and (as illustrated in dashed lines in FIG. 4) actuator 160 may be positioned in any appropriate location with respect to leading edge 112 and/or trailing edge 114.

As illustrated in FIGS. 4-7, retainer 170 may be characterized by a retainer length 172 and/or a retainer width 174, and fin base 120 may be characterized by a base width 122. Retainer width 174 may be less than or equal to base width 122, such as to permit fin base 120 to be inserted into the fin box when selective retention system 150 is in the unlocked configuration such that the fin base frictionally engages the fin box without obstruction by retainer 170.

Figure 8:
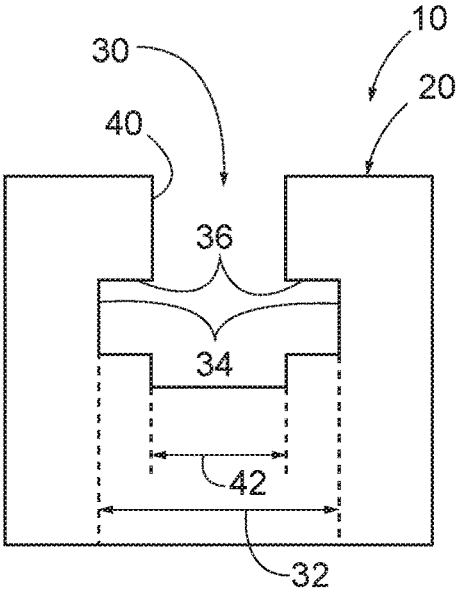
FIG. 8 is an end view of an example of a fin box according to the present disclosure.
Figure 9:
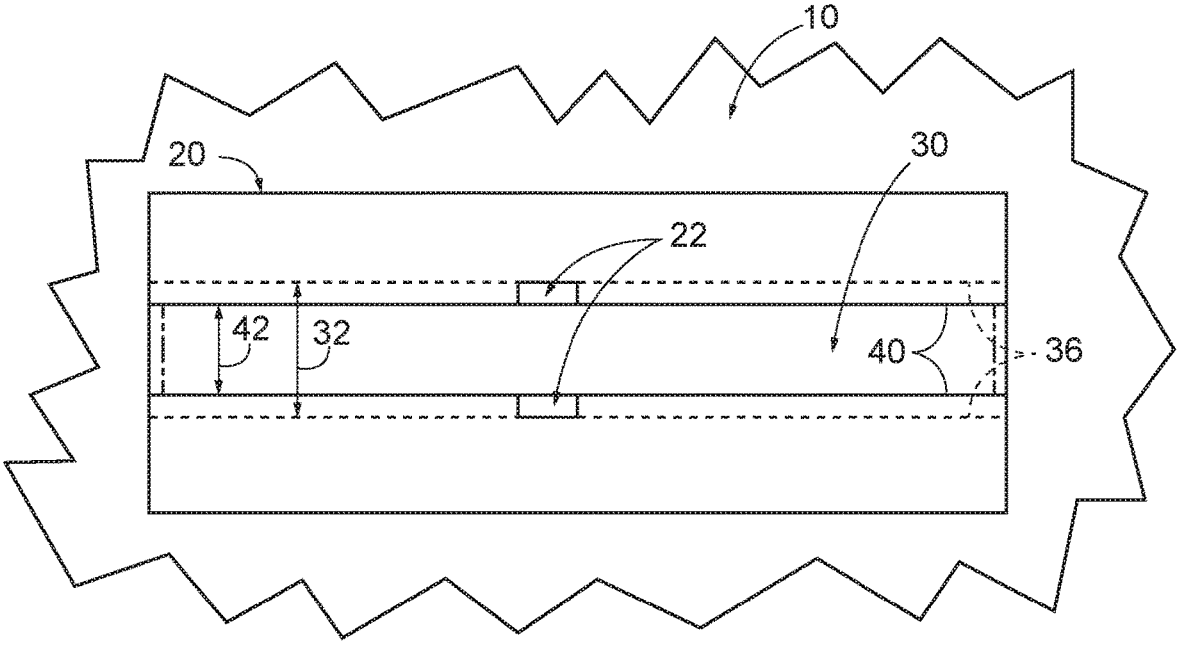
FIG. 9 is a fragmentary plan view of an example of a fin box according to the present disclosure.

FIGS. 8-9 illustrate an example of a fin box 20, such as may be a component of and/or operatively coupled to a watersport board 10, with which fin 100 is configured to be utilized. As illustrated in FIGS. 8-9, fin box 20 may include a retention channel 30 configured to receive at least a portion of fin base 120 to operatively couple fin 100 to watersport board 10. Retention channel 30 may be characterized by a retention channel width 32, and further may include a neck portion 40 with a neck width 42 that is smaller than the retention channel width. Neck portion 40 may be configured to permit access to retention channel 30 from exterior fin box 20. Stated differently, fin box 20 may be configured to receive fin base 120 via neck portion 40, and fin box 20 may be configured such that the fin base is in close-fit frictional engagement with the neck portion of the fin box when the fin base is received in the fin box. As further illustrated in FIG. 8, retention channel 30 may be described as being at least partially defined by two opposed side walls 34 such that retention channel width 32 is measured between the two opposed side walls.

When fin box 20 is recessed within the bottom surface of watersport board 10, the ends of the fin box may be closed or otherwise obstructed by the body of the watersport board. Additionally or alternatively, and also when the fin box is not recessed within the bottom surface of the watersport board, the fin box may include end walls, as indicated in dash dot lines in FIG. 9.

Figure 10:
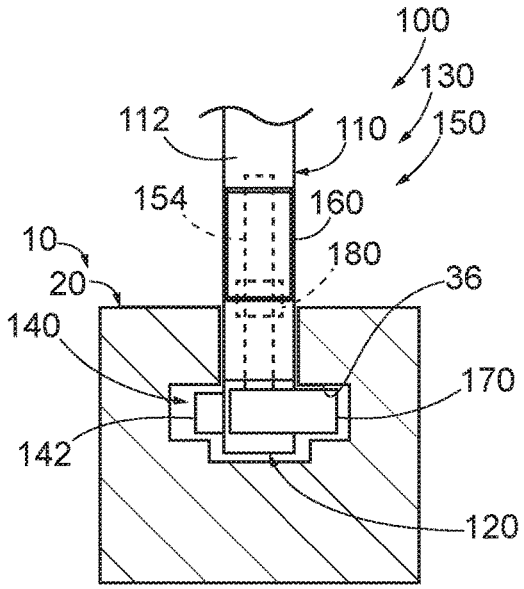
FIG. 10 is a schematic fragmentary partial cross-sectional front elevation view of examples of watersport board fins with a selective retention system in the locked configuration installed in a fin box according to the present disclosure.
Figure 11:
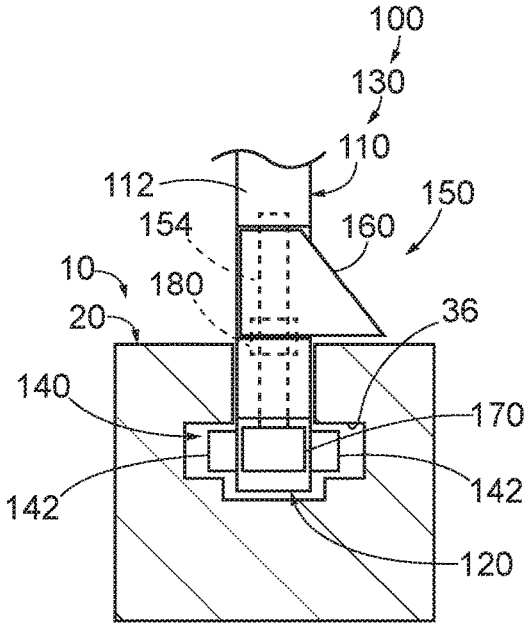
FIG. 11 is a schematic fragmentary partial cross-sectional front elevation view of the fins of FIG. 10 with the selective retention system in the unlocked configuration installed in a fin box according to the present disclosure.

As illustrated in FIGS. 8-9, retention channel 30 further may be described as being partially defined by at least one ledge 36 of fin box 20 adjacent to neck portion 40, and fin retention system 130 may be configured to restrict removal of fin base 120 from fin box 20 via obstruction by at least one ledge. For example, and as illustrated in FIGS. 10-11, static retention structure 140 may include the pair of channel pins 142 configured to be positioned under ledges 36 such that the channel pins restrict removal of fin base 120 from fin box 20 via obstruction of the channel pins by the ledges. Channel pins 142, when present, may be formed of any suitable, typically rigid, material and may be one or more of separate structures, may be part of a unitary bar or rod, may be unitary with the fin base, etc. An embodiment of fin 100 that includes at least one channel pin 142 may be configured to be utilized with a fin box 20 that includes at least one pin slot 22, as illustrated in FIG. 9. Each pin slot 22 may be defined by ledge 36, and may be configured to permit channel pin 142 to pass therethrough such that the channel pin is received in retention channel 30 when fin base 120 is received in fin box 20.

As further illustrated in FIGS. 10-11, selective retention system 150 may be configured such that retainer 170 restricts removal of fin base 120 from fin box 20 via obstruction by at least one ledge 36 when the selective retention system is in the locked configuration. For example, selective retention system 150 may be configured such that retainer 170 is at least substantially aligned with fin plane 102 when the selective retention system is in the unlocked configuration, and such that the retainer extends at least substantially transversely across retention channel 30 when the selective retention system is in the locked configuration. Accordingly, retainer length 172 may be less than retention channel width 32, such that the retainer may extend entirely transversely across retention channel 30 (i.e., such that the retainer length is aligned with the retention channel width). More specifically, and as illustrated in FIG. 10, selective retention system 150 may be configured such that retainer 170 is positioned under ledge 36 when the selective retention system is in the locked configuration such that the retainer restricts removal of fin base 120 from fin box 20 via obstruction of the retainer by the ledge. By contrast, and as illustrated in FIG. 11, when selective retention system 150 is in the unlocked configuration, retainer 170 may not be obstructed by ledge 36, and fin base 120 may be removed from fin box 20 by positioning the fin base along retention channel 30 such that channel pins 142 may pass through pin slots 22 as the fin base is removed from the fin box.

Figure 12:
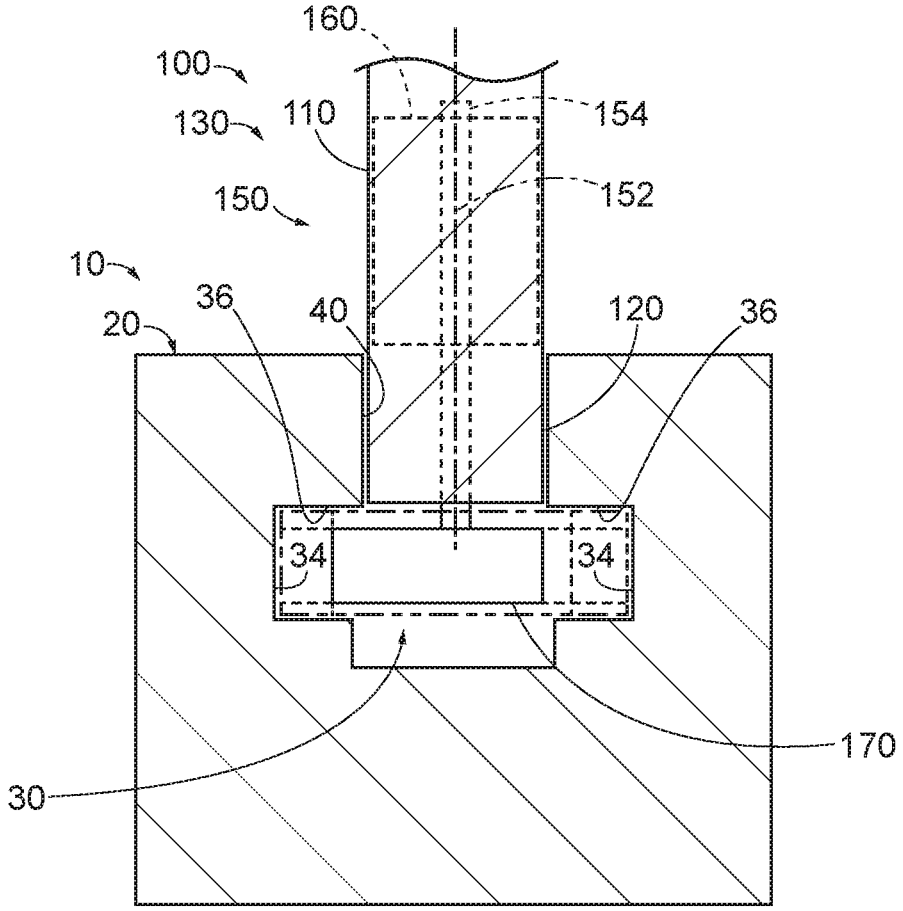
FIG. 12 is a schematic fragmentary partial cross-sectional rear elevation view of examples of watersport board fins with a selective retention system in the locked configuration installed in a fin box according to the present disclosure.
Figure 13:
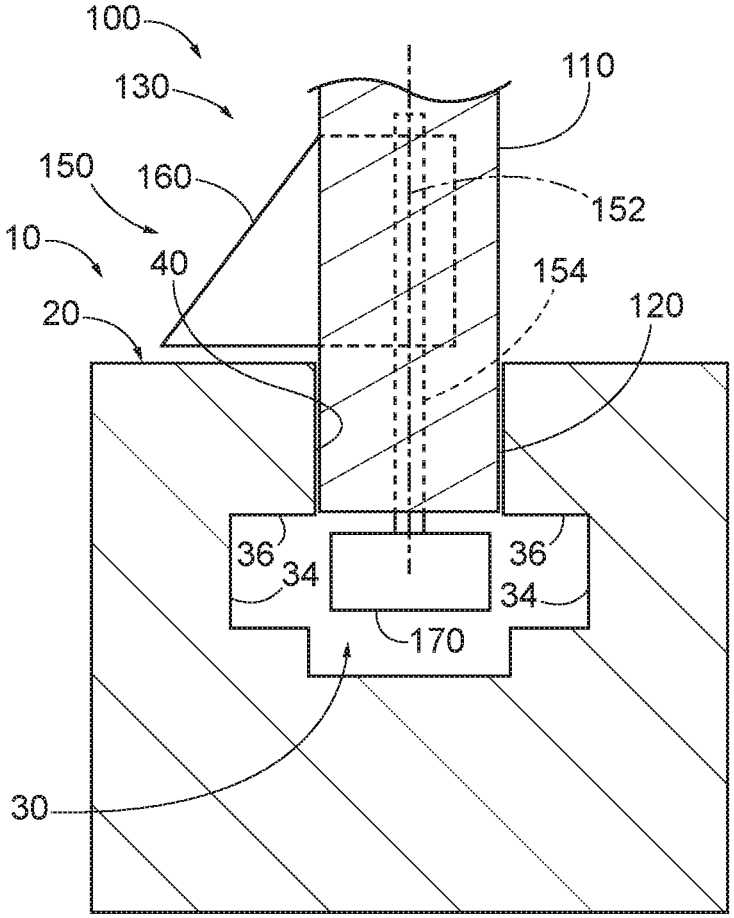
FIG. 13 is a fragmentary partial cross-sectional rear elevation view of the fins of FIG. 12 with the selective retention system in the locked configuration installed in a fin box according to the present disclosure.

FIG. 12 schematically illustrates fin 100 with fin base 120 received in fin box 20 with selective retention system 150 in the locked configuration, while FIG. 13 schematically illustrates the fin and fin box of FIG. 12 with the selective retention system in the unlocked configuration. As illustrated in FIG. 12, retainer 170 may be configured to exhibit any appropriate orientation with respect to and/or engagement with retention channel 30 when selective retention system 150 is in the locked configuration. For example, and as illustrated in solid lines in FIG. 12, retainer 170 may be configured to extend beneath one ledge 36 when selective retention system 150 is in the locked configuration, or (as illustrated in dashed lines in FIG. 12) may be configured to extend beneath each of two ledges when the selective retention system is in the locked configuration. Additionally or alternatively, and as further illustrated in solid lines in FIG. 12, retainer 170 may be configured to be spaced apart from at least one ledge 36, and/or may be configured to be spaced apart from each of the two opposed side walls 34, when selective retention system 150 is in the locked configuration. However, this is not required to all retainers 170, and it is additionally within the scope of the present disclosure that retainer 170 may be configured to engage a portion of fin box 20 and/or of retention channel 30 when selective retention system 150 is in the locked configuration. For example, and as illustrated in dashed lines in FIG. 12, retainer 170 may be configured to contact and/or engage one or both side walls 34 when selective retention system 150 is in the locked configuration. Additionally or alternatively, and as illustrated in dash-dot lines in FIG. 12, retainer 170 may be configured to engage at least one ledge 36 when selective retention system 150 is in the locked configuration. Additionally or alternatively, and as illustrated in dash-dot-dot lines in FIG. 12, retainer 170 may be configured to engage a portion of fin box 20 opposite at least one ledge 36 when selective retention system 150 is in the locked configuration. As further schematically illustrated in FIG. 12, retainer 170 may be configured to rotate symmetrically, or at least substantially symmetrically, about pivot axis 152, or may be configured to rotate asymmetrically about the pivot axis.

Figure 14:
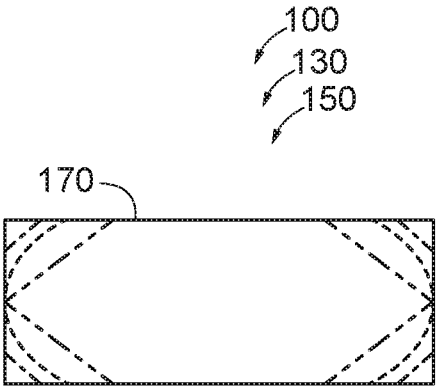
FIG. 14 is a schematic plan view of examples of a selective retention system retainer according to the present disclosure.
Figure 15:
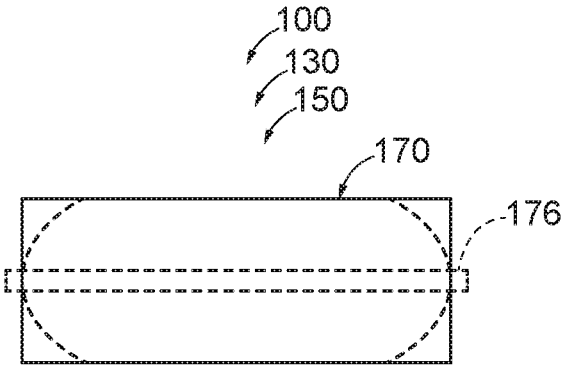
FIG. 15 is a schematic elevation view of examples of a selective retention system retainer according to the present disclosure.

Retainer 170 may have any appropriate shape adapted for pivoting within retention channel 30. As examples, and as illustrated in FIG. 14, retainer 170 may have a shape (as viewed from an underside thereof) that is triangular, quadrilateral, rectangular (as illustrated in solid lines in FIG. 14), arcuate (as illustrated in dashed lines in FIG. 14), elliptical, ovoid, chamfered (as illustrated in dash-dot lines in FIG. 14), and/or hexagonal (as illustrated in dash-dot-dot lines in FIG. 14). Additionally or alternatively, retainer 170 may have a non-rectangular shape configured such that the retainer may engage side wall 34 of retention channel 30 when selective retention system 150 is in the locked configuration without the side wall obstructing the retainer from rotating within the retention channel. Additionally, and as illustrated in FIG. 15, retainer 170 may have any appropriate profile shape (as viewed from a side thereof), such as a profile shape that is quadrilateral, rectangular (as illustrated in solid lines in FIG. 15), arcuate (as illustrated in dashed lines in FIG. 15), elliptical, ovoid, and/or chamfered.

As schematically illustrated in FIGS. 1-7, and as discussed, selective retention system 150 may include at least one retention system lock 180 that is configured to maintain the selective retention system in the locked configuration. That is, retention system lock 180 may be configured to resist unintentional transitioning of selective retention system 150 from the locked configuration to the unlocked configuration. More specifically, and as further schematically illustrated in FIGS. 4-7, retention system lock 180 may include a first component 182 and a second component 184 that is configured to engage the first component when selective retention system 150 is in the locked configuration. Retention system lock 180 may be configured such that an interaction between first component 182 and second component 184 restricts selective retention system 150 from transitioning from the locked configuration to the unlocked configuration. More specifically, retention system lock 180 and/or the interaction between first component 182 and second component 184 may be configured to permit selective retention system 150 to transition from the locked configuration to the unlocked configuration responsive to a force in excess of a threshold unlocking force being applied to the first component and/or to the second component.

Selective retention system 150 may include retention system lock 180 on any appropriate components of fin 100 and/or fin box 20. As examples, hydrodynamic blade 110, fin base 120, actuator 160, retainer 170, and/or fin box 20 may include first component 182 and/or second component 184 such that the first component and the second component may move, translate, and/or rotate with respect to one another.

As slightly less schematically illustrated in FIGS. 16-19, first component 182 and second component 184 of retention system lock 180 may include and/or be any appropriate structures for selectively resisting transitioning of selective retention system 150 from the locked configuration to the unlocked configuration.

Figure 16:
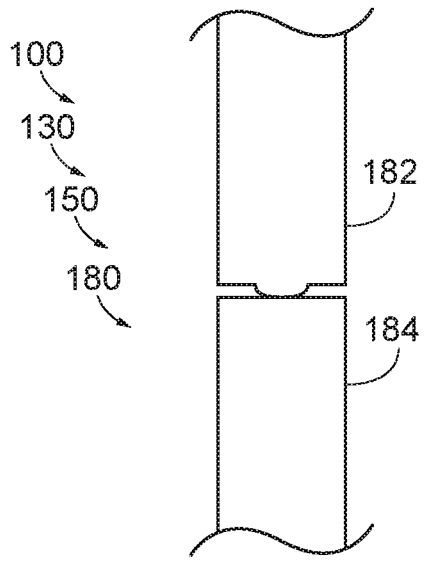
FIG. 16 is a schematic fragmentary elevation view of an example of a retention system lock according to the present disclosure.

As a first example of retention system lock 180, and as illustrated in FIG. 16, first component 182 may include a projection configured to resiliently deform against second component 184 when selective retention system 150 is in the locked configuration. In such an embodiment, first component 182 and second component 184 may be configured to produce a static frictional force therebetween when selective retention system 150 is in the locked configuration such that the threshold unlocking force is equal to the maximum static frictional force between the first component and the second component.

Figure 17:
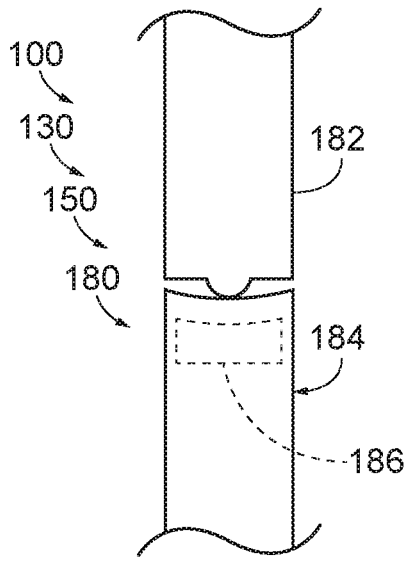
FIG. 17 is a schematic fragmentary elevation view of examples of a retention system lock according to the present disclosure.

As a second example of retention system lock 180, and as illustrated in FIG. 17, first component 182 may include a projection, such as a rigid projection, and second component 184 may be configured to resiliently deform to receive the projection of the first component when selective retention system 150 is in the locked configuration. As further illustrated in FIG. 17, second component 184 may include a deformable element 186 that is configured to facilitate the second component resiliently deforming responsive to engagement with first component 182. Deformable element 186 may be any appropriate structure configured to facilitate a deformation of second component 184, such as a cutout in the second component.

Figure 18:
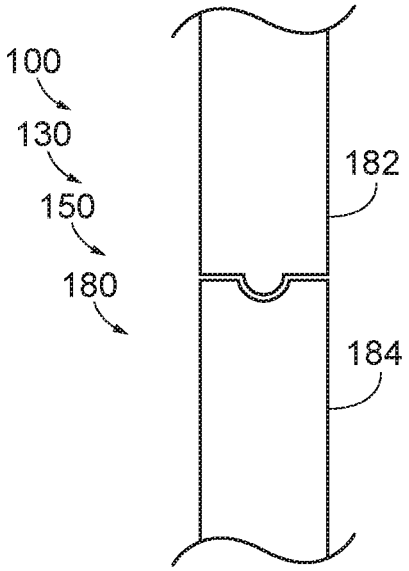
FIG. 18 is a schematic fragmentary elevation view of an example of a retention system lock according to the present disclosure.

As a third example of retention system lock 180, and as illustrated in FIG. 18, first component 182 may include a projection, and second component 184 may include a recess configured to receive the projection of the first component when selective retention system 150 is in the locked configuration. In such an embodiment, the projection of first component 182 and the recess of second component 184 may be configured to produce a static frictional force therebetween (such as a static frictional force that is less than or equal to the threshold unlocking force), may be configured to abut one another, and/or may be configured to be spaced apart from one another. In an embodiment in which the projection of first component 182 and the recess of second component 184 are spaced apart from one another, obstruction of the projection of the first component by the recess of the second component (and/or vice versa) may restrict relative motion thereof when selective retention system 150 is in the locked configuration.

Figure 19:
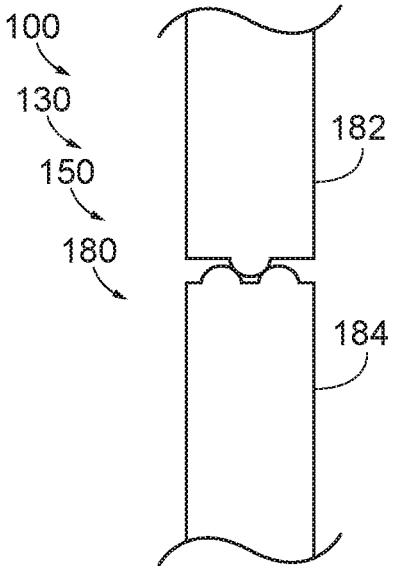
FIG. 19 is a schematic fragmentary elevation view of an example of a retention system lock according to the present disclosure.

As a fourth example of retention system lock 180, and as illustrated in FIG. 19, first component 182 may include at least one first projection, and second component 184 may include at least one second projection that is configured to engage the at least one first projection when selective retention system 150 is in the locked configuration. In such an embodiment, the at least one first projection and the at least one second projection may be configured to produce a static frictional force therebetween (such as a static frictional force that is less than or equal to the threshold unlocking force), may be configured to abut one another, and/or may be configured to be spaced apart from one another such that obstruction of the first projection(s) by the second projection (s) (and/or vice versa) restricts relative motion thereof when selective retention system 150 is in the locked configuration.

Fin 100, watersport board 10, fin box 20, and/or any components thereof may be formed of any appropriate materials, such as may be known and/or conventional in the water sports industry. As examples, hydrodynamic blade 110, fin base 120, actuator 160, retainer 170, watersport board 10, and/or fin box 20 may be formed of a plastic, a polymer, polyurethane, a fiberglass, a fiberglass fabric, a composite, carbon fiber, a metal, aluminum, steel, and/or a wood. Additionally or alternatively, and as illustrated in FIG. 15, retainer 170 may include a resilient peripheral bumper 176 that is positioned around a circumference thereof, such as may be configured to engage at least one side wall 34 of retention channel 30. When present, resilient peripheral bumper 176 may be formed of any appropriate material, such as a plastic and/or a rubber, such as may be configured to augment a frictional force between retainer 170 and side wall 34. In an embodiment of fin 100 that includes resilient peripheral bumper 176 that is configured to contact side wall 34, selective retention system 150 may be described as including retention system lock 180 in which first component 182 is the resilient peripheral bumper and second component 184 is the side wall.

Returning to FIGS. 1, 4, and 6, and as discussed, fin 100 and/or hydrodynamic blade 110 may be characterized by rake angle 104. More specifically, rake angle 104 may be measured between a line passing through a midpoint of fin base 120 and extending perpendicular to watersport board 10 when fin 100 is installed in fin box 20 and a line passing through the midpoint of the fin base and a point on hydrodynamic blade 110 distal the watersport board when the fin is installed in the fin box. Rake angle 104 may be any appropriate angle for producing a desired hydrodynamic effect when the fin is coupled to a watersport board that operates upon a body of water. As examples, rake angle 104 may be at least 10 degrees, at least 20 degrees, at least 30 degrees, at least 40 degrees, at least 50 degrees, at least 60 degrees, at most 65 degrees, at most 55 degrees, at most 45 degrees, at most 35 degrees, at most 25 degrees, at most 15 degrees, 10-50 degrees, 20-60 degrees, 30-70 degrees, 10-35 degrees, 20-45 degrees, 30-55 degrees, and/or 40-65 degrees.

Figure 20:
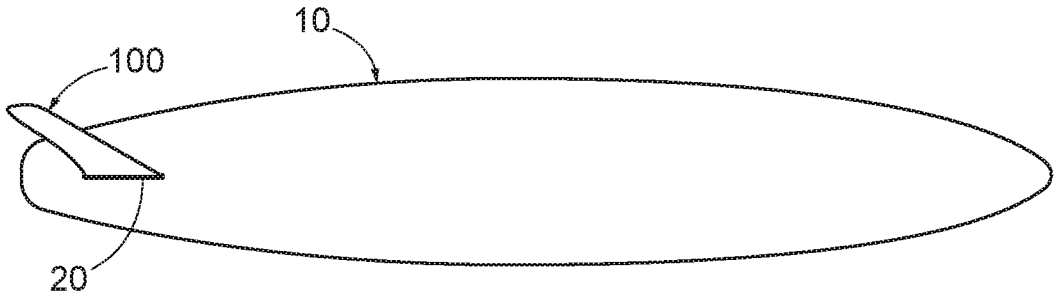
FIG. 20 is a bottom perspective view of an example of a watersport board with a watersport board fin installed in a fin box of the watersport board according to the present disclosure.
Figure 21:
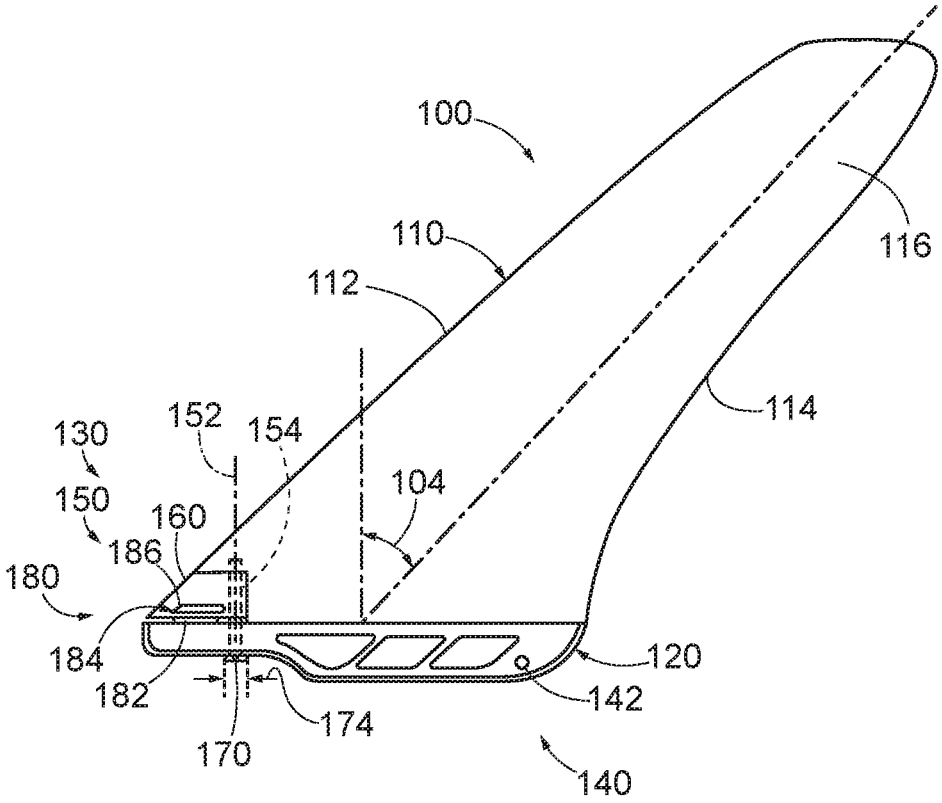
FIG. 21 is a side elevation view of an example of a watersport board fin according to the present disclosure.
Figure 22:
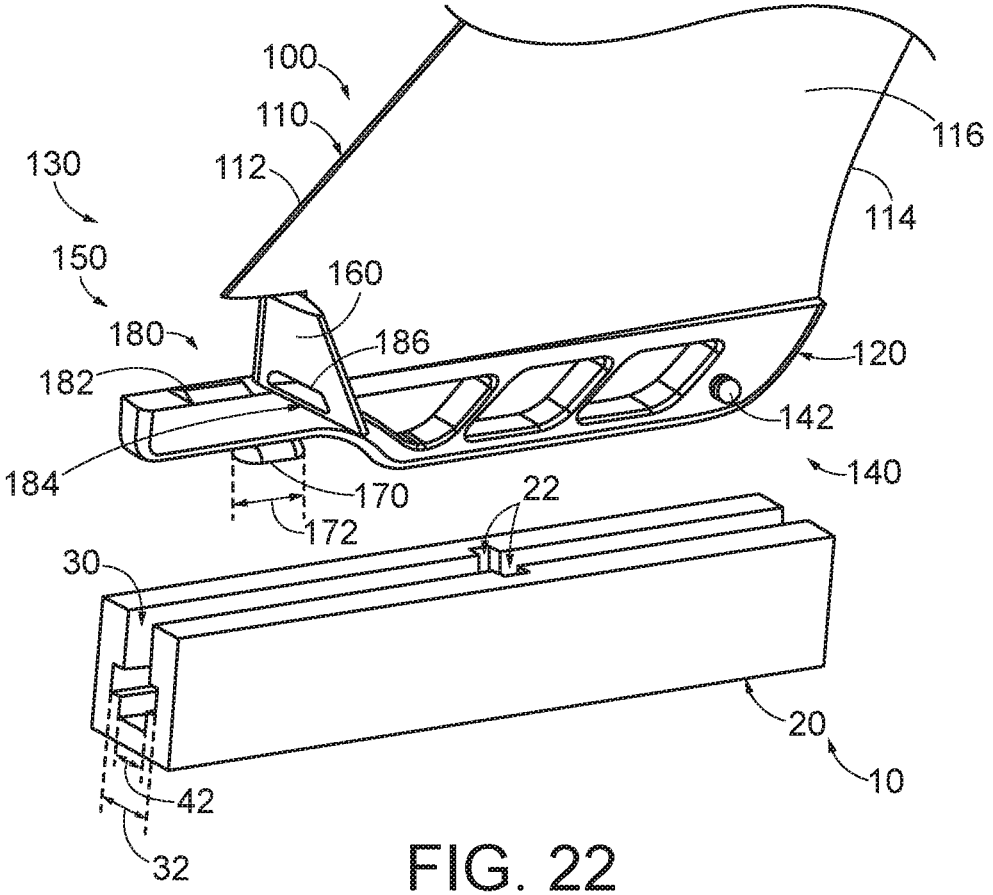
FIG. 22 is a fragmentary side perspective view of the fin of FIG. 21 with a selective retention system in the unlocked configuration that is removed from a fin box according to the present disclosure.
Figure 23:
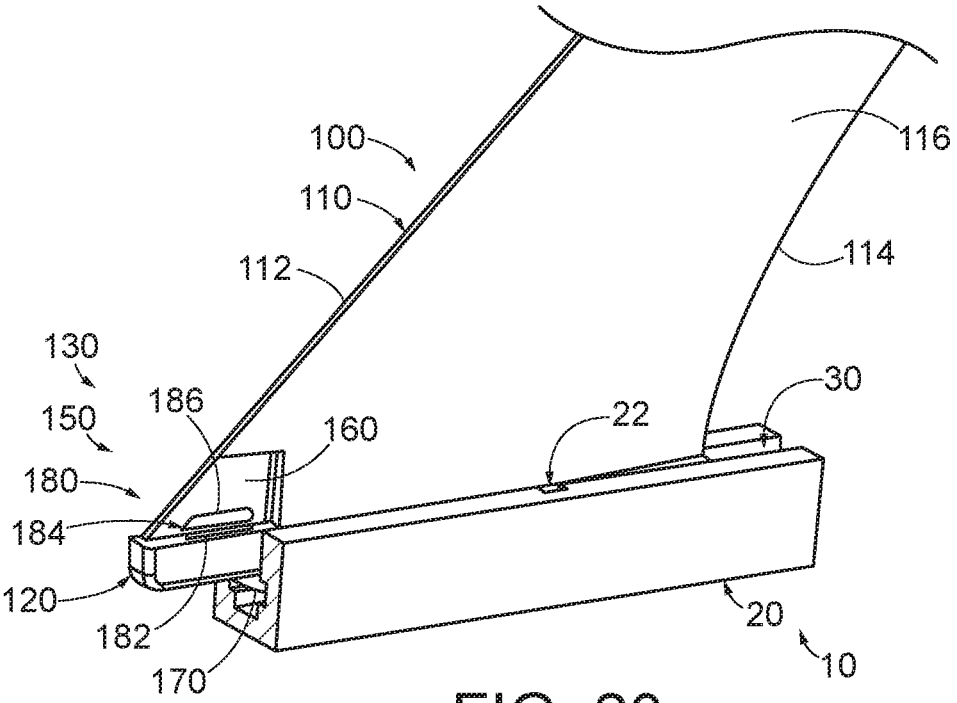
FIG. 23 is a fragmentary partial cross-sectional side perspective view of the fin of FIG. 21 with the selective retention system in the locked configuration that is installed in a fin box according to the present disclosure.

FIGS. 20-23 illustrate an example of fin 100 according to the present disclosure. Specifically, FIG. 20 illustrates fin 100 installed in fin box 20 of watersport board 10, FIG. 21 illustrates the fin in more detail, and FIGS. 22-23 illustrate the fin relative to the fin box. In particular, FIG. 22 illustrates the example of fin 100 with selective retention system 150 in the unlocked configuration, while FIG. 23 illustrates the example of fin 100 with fin base 120 received within retention channel 30 of fin base 20 and with the selective retention system in the locked configuration.

FIG. 21 illustrates an example of fin 100 that includes static retention structure 140 in the form of a pair of channel pins 142 extending from fin base 120 and in which actuator 160 forms a portion of leading edge 112 of hydrodynamic blade 110 when selective retention system 150 is in the locked configuration. The example fin 100 of FIGS. 21-23 further includes retention system lock 180, in which fin base 120 includes first component 182 and actuator 160 includes second component 184. More specifically, and as perhaps best seen in FIGS. 22-23, first component 182 is a projection from a surface of fin base 120, while second component 184 is a resiliently deformable portion of actuator 160. Second component 184 includes deformable element 186 in the form of a cutout in actuator 160 configured to facilitate a resilient deformation of the portion of the actuator in contact with first element 182 when selective retention system 150 is in the locked configuration.

Figure 24:
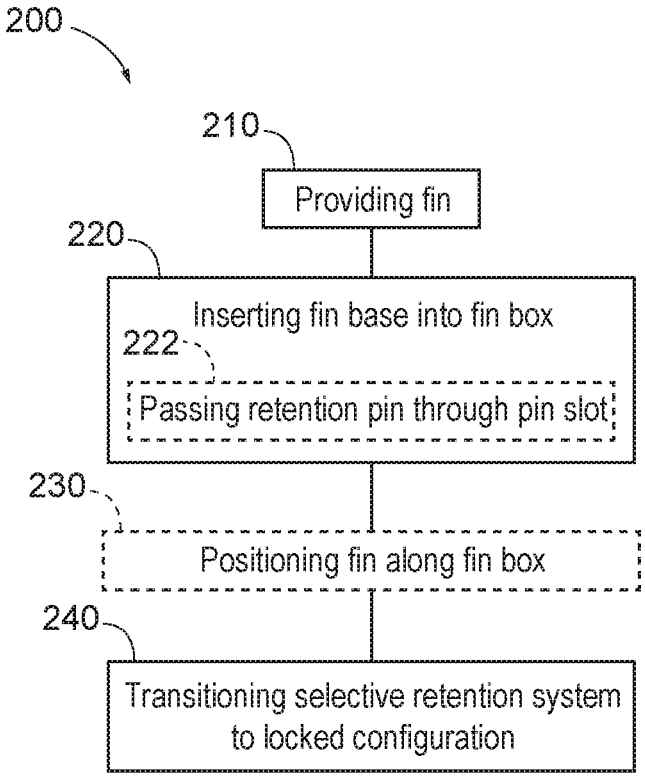
FIG. 24 is a flow chart illustrating methods for installing watersport board fins in fin boxes according to the present disclosure.

FIG. 24 provides examples of methods 200 for installing fins 100 according to the present disclosure. The methods presented in FIG. 24 are not intended to be exhaustive or required for production of all fins 100 according to the present disclosure. Similarly, methods 200 may include additional steps and/or substeps without departing from the scope of the present disclosure. Unless a particular step must be completed to enable a subsequent step to be performed, the examples of steps shown and/or discussed in connection with FIG. 24 may be performed in any suitable concurrent and/or sequential order. In the following discussion, reference numerals for the previously discussed fins 100 and components thereof are utilized to provide references to the structures shown and discussed with respect to FIGS. 1-23 even though these reference numerals are not shown in FIG. 24.

As illustrated in FIG. 24, methods 200 of installing fins 100 according to the present disclosure include providing fin 100 (as indicated at 210), inserting fin base 120 of the fin into fin box 20 (as indicated at 220), and rotating actuator 160 to transition selective retention system 150 from the unlocked configuration to the locked configuration to restrict removal of the fin base from the fin box (as indicated at 240). In general, the inserting 220 is performed with selective retention system 150 in the unlocked configuration such that neck portion 40 of fin box 20 does not obstruct retainer 170 as fin base 120 is inserted into retention channel 30.

In an embodiment of fin 100 that includes static retention structure 140 in the form of at least one channel pin 142, the inserting 220 may include passing the channel pin through a pin slot 22 of fin box 20, which may be performed prior to inserting retainer 170 into retention channel 30 of the fin box. Additionally or alternatively, methods 200 further may include positioning fin 100 longitudinally along fin box 20 within retention channel 30, as indicated at 230. For example, the positioning 230 may be performed subsequent to the inserting 220, such as to position channel pin 142 to be misaligned with pin slot 22 (and thereby enabling static retention structure 140 to restrict removal of fin base 120 from retention channel 30). As another example, the positioning 230 may include positioning fin 100 along fin box 20 to produce a desired hydrodynamic effect when watersport board 10 operates upon a body of water.

As used herein, the term "and/or" placed between a first entity and a second entity means one of (1) the first entity, (2) the second entity, and (3) the first entity and the second entity. Multiple entities listed with "and/or" should be construed in the same manner, i.e., "one or more" of the entities so conjoined. Other entities may optionally be present other than the entities specifically identified by the "and/or" clause, whether related or unrelated to those entities specifically identified. Thus, as a non-limiting example, a reference to "A and/or B," when used in conjunction with open-ended language such as "comprising" may refer, in one embodiment, to A only (optionally including entities other than B); in another embodiment, to B only (optionally including entities other than A); in yet another embodiment, to both A and B (optionally including other entities). These entities may refer to elements, actions, structures, steps, operations, values, and the like.

As used herein, the phrase "at least one," in reference to a list of one or more entities should be understood to mean at least one entity selected from any one or more of the entity in the list of entities, but not necessarily including at least one of each and every entity specifically listed within the list of entities and not excluding any combinations of entities in the list of entities. This definition also allows that entities may optionally be present other than the entities specifically identified within the list of entities to which the phrase "at least one" refers, whether related or unrelated to those entities specifically identified. Thus, as a non-limiting example, "at least one of A and B" (or, equivalently, "at least one of A or B," or, equivalently "at least one of A and/or B") may refer, in one embodiment, to at least one, optionally including more than one, A, with no B present (and optionally including entities other than B); in another embodiment, to at least one, optionally including more than one, B, with no A present (and optionally including entities other than A); in yet another embodiment, to at least one, optionally including more than one, A, and at least one, optionally including more than one, B (and optionally including other entities). In other words, the phrases "at least one," "one or more," and "and/or" are open-ended expressions that are both conjunctive and disjunctive in operation. For example, each of the expressions "at least one of A, B and C," "at least one of A, B, or C," "one or more of A, B, and C," "one or more of A, B, or C" and "A, B, and/or C" may mean A alone, B alone, C alone, A and B together, A and C together, B and C together, A, B and C together, and optionally any of the above in combination with at least one other entity.

As used herein, the phrase, "for example," the phrase, "as an example," and/or simply the term "example," when used with reference to one or more components, features, details, structures, embodiments, and/or methods according to the present disclosure, are intended to convey that the described component, feature, detail, structure, embodiment, and/or method is an illustrative, non-exclusive example of components, features, details, structures, embodiments, and/or methods according to the present disclosure. Thus, the described component, feature, detail, structure, embodiment, and/or method is not intended to be limiting, required, or exclusive/exhaustive; and other components, features, details, structures, embodiments, and/or methods, including structurally and/or functionally similar and/or equivalent components, features, details, structures, embodiments, and/or methods, are also within the scope of the present disclosure.

As used herein the terms "adapted" and "configured" mean that the element, component, or other subject matter is designed and/or intended to perform a given function. Thus, the use of the terms "adapted" and "configured" should not be construed to mean that a given element, component, or other subject matter is simply "capable of" performing a given function but that the element, component, and/or other subject matter is specifically selected, created, implemented, utilized, programmed, and/or designed for the purpose of performing the function.

It is also within the scope of the present disclosure that elements, components, and/or other recited subject matter that is recited as being adapted to perform a particular function may additionally or alternatively be described as being configured to perform that function, and vice versa.

Examples of watersport board fins according to the present disclosure, watersport boards including the same, and methods for installing fins on watersport boards according to the present disclosure are presented in the following enumerated paragraphs.

A1. A fin to be inserted into a fin box of a watersport board for stabilizing the watersport board during use on a body of water, the fin comprising:

a hydrodynamic blade that is configured to extend into a body of water when the fin is coupled to a watersport board that operates upon the body of water, wherein the hydrodynamic blade defines a fin plane and includes a leading edge, a trailing edge, and a foil surface extending between the leading edge and the trailing edge;

a fin base extending from the hydrodynamic blade and configured to be selectively received within a fin box of the watersport board; and a fin retention system that is configured to restrict removal of the fin base from the fin box, wherein the fin retention system includes a selective retention system configured to selectively transition between an unlocked configuration, in which the selective retention system permits the fin to be inserted into and removed from the fin box, and a locked configuration, in which the selective retention system restricts the fin from being inserted into and removed from the fin box, wherein the selective retention system includes:

a retainer that is configured to extend within a retention channel of the fin box to restrict removal of the fin base from the fin box when the fin base is inserted into the fin box and the selective retention system is in the locked configuration and to pivot about a pivot axis when the selective retention system is transitioned between the unlocked configuration and the locked configuration; and an actuator that is coupled to the retainer via a pivot shaft and that is configured to be actuated by a user to pivot the retainer about the pivot axis to selectively transition the selective retention system between the unlocked configuration and the locked configuration;

wherein the actuator forms a portion of the hydrodynamic blade when the selective retention system is in the locked configuration; wherein the actuator is configured to rotate away from the fin plane when the selective retention system transitions from the locked configuration to the unlocked configuration; and wherein the retainer is configured to rotate away from the fin plane when the selective retention system transitions from the unlocked configuration to the locked configuration.

A2. The fin of paragraph A1, wherein the retention channel of the fin box has a retention channel width, wherein the fin box further includes a neck portion configured to permit access to the retention channel from exterior the fin box, wherein the neck portion has a neck width that is smaller than the retention channel width; wherein the retention channel is at least partially defined by at least one ledge adjacent to the neck portion; wherein the fin base is configured to be at least partially received in the retention channel; and wherein the retainer is configured to extend transversely across the retention channel when the selective retention system is in the locked configuration.

A3. The fin of paragraph A2, wherein the retainer is configured to be obstructed from removal from the fin box by the at least one ledge when the fin base is inserted into the fin box and when the selective retention system is in the locked configuration.

A4. The fin of any of paragraphs A2-A3, wherein the retainer is configured to be spaced apart from the at least one ledge when the fin base is inserted into the fin box and when the selective retention system is in the locked configuration.

A5. The fin of any of paragraphs A2-A4, wherein the retainer is configured to engage at least one ledge when the fin base is inserted into the fin box and when the selective retention system is in the locked configuration.

A6. The fin of any of paragraphs A1-A5, wherein the retention channel is at least partially defined by two opposed side walls, wherein the retention channel width is measured between the two opposed side walls, and wherein the retainer is configured to be spaced apart from each of the two opposed side walls when the fin base is inserted into the fin box and when the selective retention system is in the locked configuration.

A7. The fin of any of paragraphs A1-A5, wherein the retention channel is at least partially defined by a/the two opposed side walls, and wherein the retainer is configured to engage at least one of the two opposed side walls when the fin base is inserted into the fin box and when the selective retention system is in the locked configuration.

A8. The fin of any of paragraphs A2-A7, wherein the retainer has a retainer length that is less than the retention channel width.

A9. The fin of any of paragraphs A2-A8, wherein the fin retention system includes a static retention structure that is configured to restrict removal of the fin base from the fin box via obstruction of the static retention structure by the at least one ledge.

A10. The fin of paragraph A9, wherein the static retention structure includes at least one channel pin extending from a surface of the fin base, wherein the fin box includes at least one pin slot that is defined by the at least one ledge and is configured to permit the at least one channel pin to pass therethrough, and wherein the at least one channel pin is configured to be received in the retention channel when the fin base is received in the retention channel.

A11. The fin of any of paragraphs A1-A10, wherein the actuator forms a portion of the leading edge of the hydrodynamic blade when the selective retention system is in the locked configuration.

A12. The fin of any of paragraphs A1-A11, wherein the actuator forms a portion of the trailing edge of the hydrodynamic blade when the selective retention system is in the locked configuration.

A13. The fin of any of paragraphs A1-A10, wherein the actuator is spaced apart from each of the leading edge and the trailing edge of the hydrodynamic blade when the selective retention system is in the locked configuration.

A14. The fin of any of paragraphs A1-A13, wherein the actuator conforms to the foil surface of the hydrodynamic blade when the selective retention system is in the locked configuration.

A15. The fin of any of paragraphs A1-A14, wherein the selective retention system further includes at least one retention system lock that is configured to maintain the selective retention system in the locked configuration.

A16. The fin of paragraph A15, wherein the retention system lock is configured to resist unintentional transitioning of the selective retention system from the locked configuration to the unlocked configuration.

A17. The fin of any of paragraphs A15-A16, wherein the retention system lock includes a first component and a second component that is configured to engage the first component when the selective retention structure is in the locked configuration, wherein the retention system lock is configured such that an interaction between the first component and the second component restricts the selective retention structure from transitioning from the locked configuration to the unlocked configuration, and wherein the retention system lock further is configured to permit the selective retention structure to transition from the locked configuration to the unlocked configuration responsive to a force in excess of a threshold unlocking force being applied to at least one of the first component and the second component.

A18. The fin of paragraph A17, wherein at least one of the actuator, the hydrodynamic blade, the fin base, the retainer, and the fin box includes the first component of the retention system lock.

A19. The fin of any of paragraphs A17-A18, wherein at least one of the actuator, the hydrodynamic blade, the fin base, the retainer, and the fin box includes the second component of the retention system lock.

A20. The fin of any of paragraphs A17-A19, wherein the first component of the retention system lock includes a projection that is configured to resiliently deform against the second component of the retention system lock when the selective retention structure is in the locked configuration.

A21. The fin of any of paragraphs A17-A20, wherein the first component of the retention system lock includes a projection, and wherein the second component of the retention system lock includes a recess that is configured to receive the projection when the selective retention structure is in the locked configuration.

A22. The fin of any of paragraphs A17-A21, wherein the first component of the retention system lock includes a projection, and wherein the second component of the retention system lock is configured to resiliently deform to receive the projection of the first component of the retention system lock when the selective retention structure is in the locked configuration.

A23. The fin of paragraph A22, wherein the second component of the retention system lock includes a deformable element that is configured to facilitate the second component resiliently deforming responsive to engagement with the first component.

A24. The fin of paragraph A23, wherein the deformable element includes a cutout in the second component of the retention system lock.

A25. The fin of any of paragraphs A17-A24, wherein the first component of the retention system lock includes at least one first projection, and wherein the second component of the retention system lock includes at least one second projection that is configured to engage the at least one first projection when the selective retention structure is in the locked configuration.

A26. The fin of any of paragraphs A1-A25, wherein the retainer is configured to rotate symmetrically, or at least substantially symmetrically, about the pivot axis.

A27. The fin of any of paragraphs A1-A25, wherein the retainer is configured to rotate asymmetrically about the pivot axis.

A28. The fin of any of paragraphs A1-A27, wherein the actuator is at least substantially aligned with the fin plane when the selective retention system is in the locked configuration.

A29. The fin of any of paragraphs A1-A28, wherein the retainer is at least substantially aligned with the fin plane when the selective retention system is in the unlocked configuration.

A30. The fin of any of paragraphs A1-A29, wherein the hydrodynamic blade is formed of at least one of a plastic, a polymer, polyurethane, a fiberglass, a fiberglass fabric, a composite, carbon fiber, a metal, aluminum, steel, and a wood.

A31. The fin of any of paragraphs A1-A30, wherein the actuator is formed of at least one of a plastic, a polymer, polyurethane, a fiberglass, a fiberglass fabric, a composite, carbon fiber, a metal, aluminum, steel, and a wood.

A32. The fin of any of paragraphs A1-A31, wherein the fin base is formed of at least one of a plastic, a polymer, polyurethane, a fiberglass, a fiberglass fabric, a composite, carbon fiber, a metal, aluminum, steel, and a wood.

A33. The fin of any of paragraphs A1-A32, wherein the retainer is formed of at least one of a plastic, a polymer, polyurethane, a fiberglass, a fiberglass fabric, a composite, carbon fiber, a metal, aluminum, steel, and a wood.

A34. The fin of any of paragraphs A1-A33, wherein the retainer includes a resilient peripheral bumper that includes at least one of a plastic and a rubber.

A35. The fin of any of paragraphs A1-A34, wherein the fin box is formed of at least one of a plastic, a polymer, polyurethane, a fiberglass, a fiberglass fabric, a composite, carbon fiber, a metal, aluminum, steel, and a wood.

A36. The fin of any of paragraphs A1-A35, wherein the hydrodynamic blade has a cross-sectional shape that includes at least one of an airfoil and a hydrofoil.

A37. The fin of any of paragraphs A1-A36, wherein the fin has a rake angle, as measured between a line passing through a midpoint of the fin base and extending perpendicular to the watersport board when the fin is installed in the fin box and a line passing through the midpoint of the fin base and a point on the hydrodynamic blade distal the watersport board when the fin is installed in the fin box, and wherein the rake angle is at least one of at least 10 degrees, at least 20 degrees, at least 30 degrees, at least 40 degrees, at least 50 degrees, at least 60 degrees, at most 65 degrees, at most 55 degrees, at most 45 degrees, at most 35 degrees, at most 25 degrees, at most 15 degrees, 10-50 degrees, 20-60 degrees, 30-70 degrees, 10-35 degrees, 20-45 degrees, 30-55 degrees, and 40-65 degrees.

A38. The fin of any of paragraphs A1-A37, wherein the retainer is at least one of triangular, quadrilateral, rectangular, hexagonal, elliptical, ovoid, rounded, and chamfered.

B1. A watersport board assembly, comprising:

the fin of any of paragraphs A1-A38; and a watersport board with a fin box configured to selectively receive the fin of any of paragraphs A1-A38.

B2. A watersport board, comprising:

a watersport board with a fin box; and the fin of any of paragraphs A1-A38 operatively coupled to the fin box.

C1. A method for coupling a fin to a watersport board, the method comprising:

providing the fin of any of paragraphs A1-A38;

with the selective retention system in the unlocked configuration, inserting the fin base at least partially into the fin box; and rotating the actuator to transition the selective retention system from the unlocked configuration, in which the retainer is aligned with the fin plane, to the locked configuration, in which the retainer extends out of the fin plane to restrict removal of the fin base from the fin box.

C2. The method of paragraph C2, wherein the method further includes, prior to the rotating the actuator, positioning the fin longitudinally along the fin box.

C3. The method of paragraph C3, wherein the fin includes a/the at least one channel pin extending from a surface of the fin base, wherein the fin box includes a/the at least one pin slot that is configured to permit the at least one channel pin to pass therethrough, and wherein the inserting the fin base at least partially into the fin box includes passing the at least one channel pin through the at least one pin slot prior to inserting the retainer into the retention channel of the fin box.

INDUSTRIAL APPLICABILITY

The watersport board fins, watersport boards, and methods disclosed herein are applicable to the water sports industry.

It is believed that the disclosure set forth above encompasses multiple distinct inventions with independent utility.

While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions and/or properties disclosed herein. Similarly, where the claims recite "a" or "a first" element or the equivalent thereof, such claims should be understood to include incorporation of one or more such elements, neither requiring nor excluding two or more such elements.

It is believed that the following claims particularly point out certain combinations and subcombinations that are directed to one of the disclosed inventions and are novel and non-obvious. Inventions embodied in other combinations and subcombinations of features, functions, elements, and/or properties may be claimed through amendment of the present claims or presentation of new claims in this or a related application. Such amended or new claims, whether they are directed to a different invention or directed to the same invention, whether different, broader, narrower, or equal in scope to the original claims, are also regarded as included within the subject matter of the inventions of the present disclosure.

The invention claimed is:

1. A fin configured to be selectively and operatively coupled to a watersport board, the fin comprising:

a fin base that is configured to be at least partially received within the watersport board when the fin is operatively coupled to the watersport board;

a hydrodynamic blade extending from the fin base and configured to extend into a body of water when the fin is operatively coupled to the watersport board and when the watersport board operates upon the body of water;

a retainer configured to transition between a locked position, in which the fin base is restricted from removal or insertion into the watersport board, and an unlocked position, in which the fin base can be removed from or inserted into the watersport board; and an actuator configured to transition the retainer between the locked position and unlocked position, wherein the actuator forms a portion of the hydrodynamic blade when the retainer is in the locked position, such that an edge of the hydrodynamic blade aligns with an edge of the retainer when the retainer is in the locked position.

2. The fin of claim 1, wherein the retainer is configured to maintain a fixed distance from the hydrodynamic blade.

3. The fin of claim 1, further comprising an actuator recess in the hydrodynamic blade, the actuator being configured to be at least partially received within the actuator recess to transition the retainer from the unlocked position to the locked position.

4. The fin of claim 1, wherein the actuator comprises an integral portion of the hydrodynamic blade when the retainer is in the locked position.

5. The fin of claim 1, wherein the actuator is configured to maintain a second fixed distance from the fin base.

6. The fin of claim 1, wherein the fin base is configured to be at least partially received within a fin box of the watersport board when the fin is operatively coupled to the watersport board and wherein the retainer further comprises:

a retainer latch that is configured to extend within a retention channel of the fin box to restrict removal of the fin base from the fin box when the fin base is inserted into the fin box and the retainer is in the locked position.

7. A fin to be selectively and operatively coupled to a watersport board, the fin comprising:

a fin base that is configured to be at least partially received within the watersport board when the fin is operatively coupled to the watersport board;

a hydrodynamic blade extending from the fin base and configured to extend into a body of water when the fin is operatively coupled to the watersport board and when the watersport board operates upon the body of water;

a retainer configured to transition between a locked position, in which the fin base is restricted from removal or insertion into the watersport board, and an unlocked position, in which the fin base can be removed from or inserted into the watersport board; and an actuator configured to transition the retainer between the locked position and the unlocked position, wherein an edge of the actuator is aligned with an edge of the hydrodynamic blade when the retainer is in the locked position, such that the edge of the actuator and the edge of the hydrodynamic blade form a single edge.

8. The fin of claim 7, wherein the retainer is configured to maintain a fixed distance from the fin base.

9. The fin of claim 7, further comprising an actuator recess in the hydrodynamic blade, the actuator being configured to be at least partially received within the actuator recess to transition the retainer from the unlocked position to the locked position.

10. The fin of claim 7, wherein the actuator comprises an integral portion of the hydrodynamic blade when the retainer is in the locked position.

11. The fin of claim 7, wherein the fin base is configured to be at least partially received within a fin box of the watersport board when the fin is operatively coupled to the watersport board and wherein the retainer further comprises:

a retainer latch that is configured to extend within a retention channel of the fin box to restrict removal of the fin base from the fin box when the fin base is inserted into the fin box and the retainer is in the locked position.

12. The fin of claim 7, wherein the actuator is configured to pivot about a pivot axis to thereby transition the retainer between the locked position and the unlocked position.

13. A fin to be selectively and operatively coupled to a watersport board, the fin comprising:

a fin base that is configured to be at least partially received within the watersport board when the fin is operatively coupled to the watersport board;

a hydrodynamic blade that extends from the fin base and that is configured to extend into a body of water when the fin is operatively coupled to the watersport board and when the watersport board operates upon the body of water;

a retainer configured to transition between a locked position, in which the fin base is restricted from removal or insertion into the watersport board, and an unlocked position, in which the fin base can be removed from or inserted into the watersport board;

an actuator configured to transition the retainer between the locked position and unlocked position; and an actuator recess in the hydrodynamic blade, the actuator being configured to be at least partially received within the actuator recess to transition the retainer from the unlocked position to the locked position.

14. The fin of claim 13, wherein the actuator forms part of a leading edge of the hydrodynamic blade when retainer is in the locked position.

15. The fin of claim 13, wherein the retainer is configured to maintain a fixed distance from the fin base.

16. The fin of claim 13, wherein the actuator is configured to maintain a second fixed distance from the fin base.

17. The fin of clam 15, wherein the fin base is configured to be at least partially received within a fin box of the watersport board when the fin is operatively coupled to the watersport board and wherein the retainer further comprises:

a retainer latch that is configured to extend within a retention channel of the fin box to restrict removal of the fin base from the fin box when the fin base is inserted into the fin box and the retainer is in the locked position.

* * * * *